United States Patent [19]

Caddock

[11] 4,075,968

[45] Feb. 28, 1978

[54] APPARATUS FOR MANUFACTURING CYLINDRICAL RESISTORS BY THICK-FILM SILK-SCREENING

[76] Inventor: Richard E. Caddock, 640 Sandalwood Court, Riverside, Calif. 92507

[21] Appl. No.: 703,460

[22] Filed: Jul. 8, 1976

Related U.S. Application Data

[60] Continuation of Ser. No. 530,751, Dec. 9, 1974, abandoned, which is a division of Ser. No. 424,810, Dec. 14, 1973, Pat. No. 3,880,609, which is a continuation-in-part of Ser. No. 315,018, Dec. 14, 1972, abandoned.

[51] Int. Cl.[2] ..... B05C 1/16; B41M 1/12

[52] U.S. Cl. ..... 118/7; 101/124; 101/126; 118/213; 118/233

[58] Field of Search ..... 118/213, 7, 203, 233, 118/241; 101/124, 126, 38, 129

[56] References Cited

U.S. PATENT DOCUMENTS

| | | | |
|---|---|---|---|
| 1,930,153 | 10/1933 | Smith et al. | 101/124 |
| 2,301,119 | 11/1942 | Holbrook | 101/124 |
| 2,498,917 | 2/1950 | Gattuso | 101/124 |
| 2,629,321 | 2/1953 | Gattuso | 101/126 |
| 3,028,803 | 4/1962 | Steede | 101/124 |
| 3,109,365 | 11/1963 | Karlyn | 101/124 |
| 3,249,045 | 5/1966 | Karlyn | 101/126 X |

*Primary Examiner*—John P. McIntosh
*Attorney, Agent, or Firm*—Richard L. Gausewitz

[57] ABSTRACT

A "silk screen" is provided with a patterned pervious portion the dimension of which, in the direction of screen movement, is substantially less than the circumference of the cylindrical substrate. The screen is then moved beneath a squeegee through a distance which is greater than the indicated dimension of the pattern but less than the substrate circumference, the result being that a thick film of resistive material is metered onto the substrate without any overlapping or smearing. The squeegee, at the end of the screen-printing stroke, is located at an impervious portion of the screen, so that even unspindled small-diameter ceramic substrates are disengaged from the screen with no sticking or smearing. Such cylindrical substrates are solid in order to be economical, and to permit zero moisture intrusion. It is a feature of the invention that such economical solid substrates can be used, and are driven solely by screen friction so that loading, unloading and other problems are minimized.

The apparatus makes use of limit switches, an air cylinder, a certain type of stabilized squeegee, and friction-minimizing components to effect very smooth and substantially vertical lift-off of the squeegee from a precisely-determined region of the screen, the result being that a high degree of repeatability is achieved. The apparatus further employs a certain type of cylinder carriage, and preset stop devices, to make it extremely easy to load and unload the machine and to make it simple to change to different sizes of cylindrical substrates. The apparatus employs a compound lever system for the squeegee support arm and the flood-bar support arm, which system operates smoothly and simply to achieve the precise desired movements of the flood bar and squeegee. The apparatus employs an air jet in a predetermined manner to separate certain types of resistors from the screen, thus greatly extending the capability of the apparatus.

18 Claims, 17 Drawing Figures

FIG. 6a.
FIG. 6.
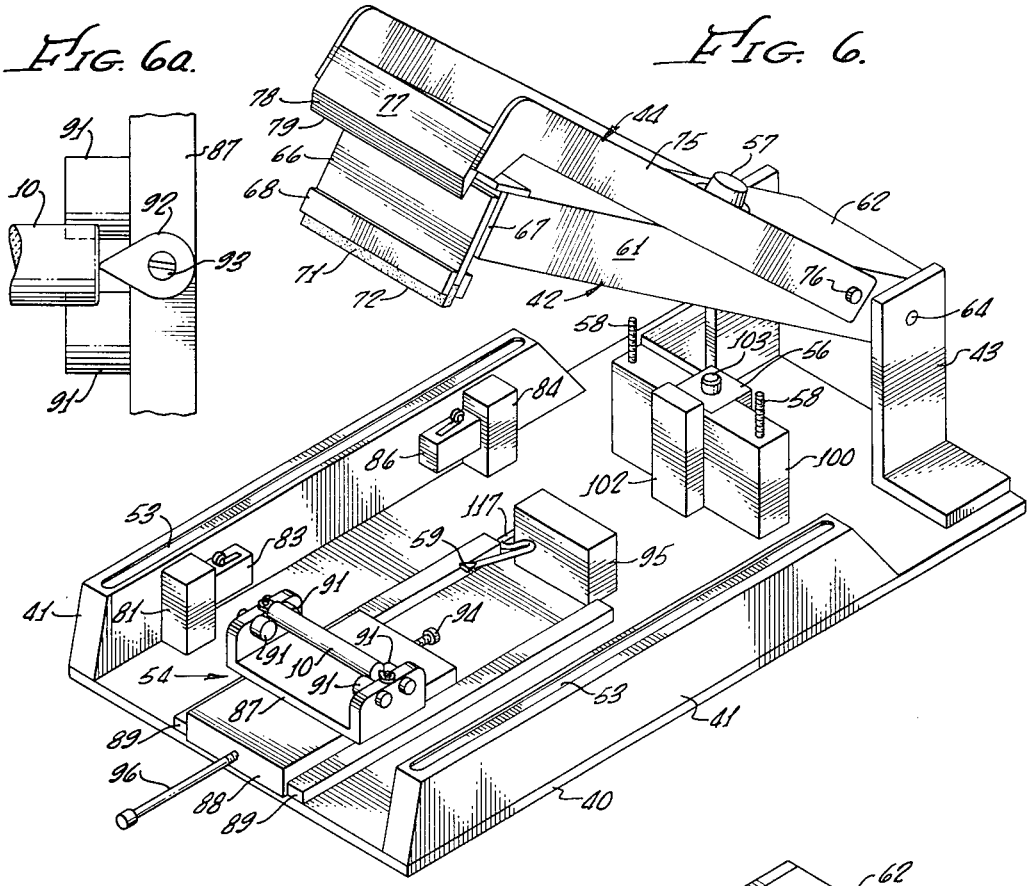
FIG. 7.
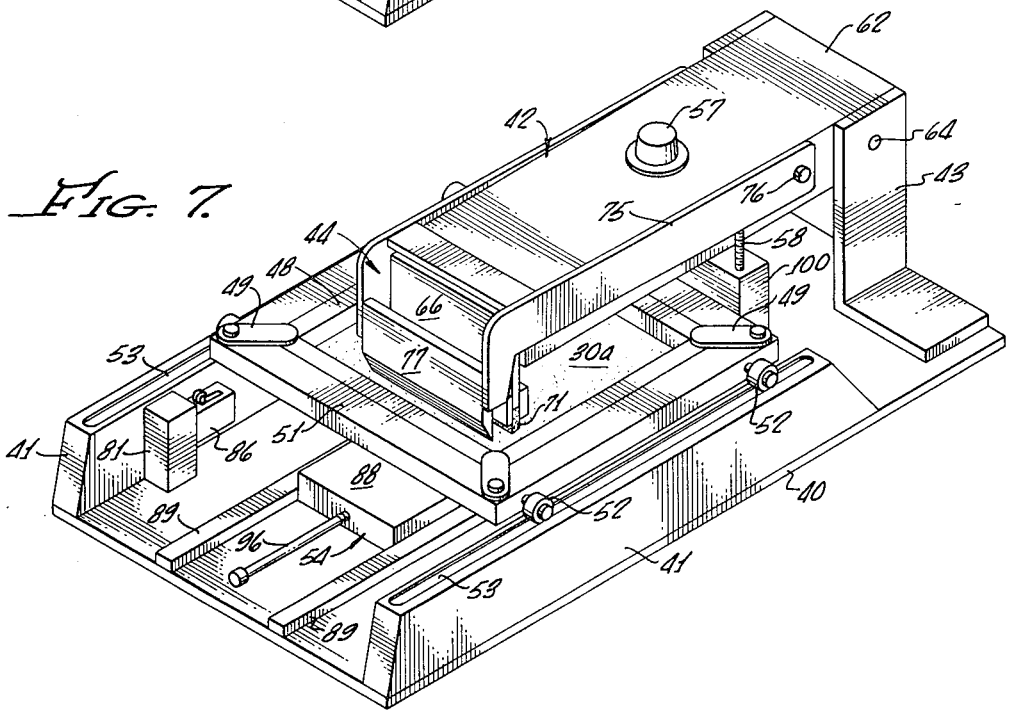

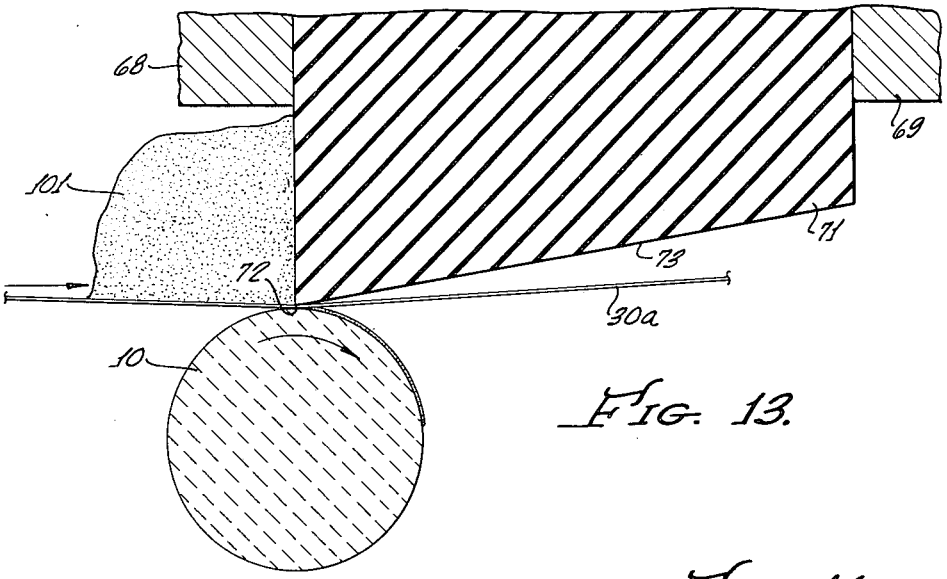
FIG. 13.
FIG. 14.
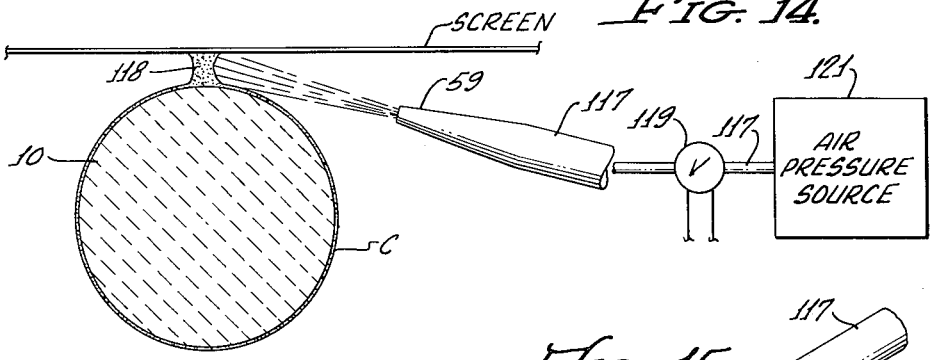
FIG. 15.
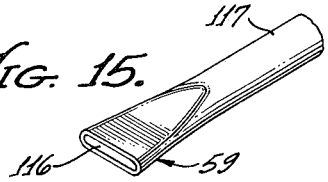
FIG. 16.
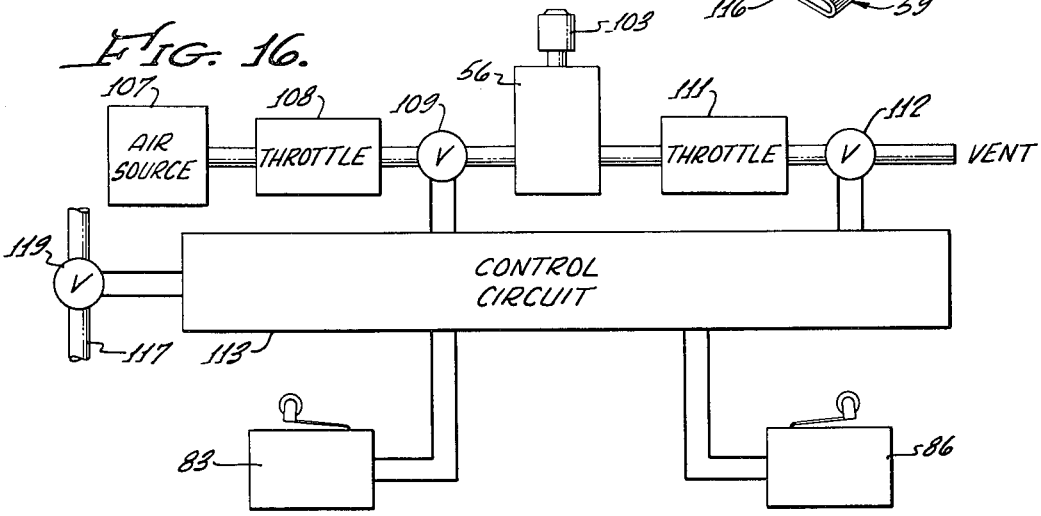

APPARATUS FOR MANUFACTURING CYLINDRICAL RESISTORS BY THICK-FILM SILK-SCREENING

CROSS REFERENCE TO RELATED APPLICATION

This application is a continuation of application Ser. No. 530,751, filed Dec. 9, 1974, for Method and Apparatus for Manufacturing Cylindrical Resistors by Thick-Film silk-screening now abandoned, which application is a division of application Ser. No. 424,810, filed Dec. 14, 1973, for Method and Apparatus for Manufacturing Cylindrical Resistors by Thick-Film Silk-Screening, now U.S. Pat. No. 3,880,609, which application Ser. No. 424,810 is, in turn, a continuation-in-part of application Ser. No. 315,018, filed Dec. 14, 1972, now abandoned, for Non-Inductive Film-Type Cylindrical Resistor, and Method of Making the Same. The entire disclosure of said U.S. Pat. No. 3,880,609 is hereby incorporated by reference herein as though set forth in full.

BACKGROUND OF THE INVENTION

1. Field of the Invention

This invention relates to the field of apparatus for manufacturing film-type resistors wherein a film of resistive material is provided on the exterior surface of a cylinder. Throughout this specification and claims, the word "cylinder" is used in its conventional sense (a surface generated by a straight line moving parallel to a fixed straight axis and intersecting a fixed circle, the circle lying in a plane perpendicular to said axis, the circle having said axis at its center).

2. Description of Prior Art

It has long been thought that silk-screening is impractical in the field of film-type cylindrical resistors, particularly those having very small diameters and/or being of the economical and moisture-resistant solid ceramic variety. It is believed that the thinking of prior-art workers was largely locked to the traditional helical film pattern, and a helix may not be silk-screened without overprinting part of the pattern. Overprinting is often fatal to the integrity of a film-type resistor where the film is a line, since overprinting produces disuniform film thicknesses as well as tending toward smudging and thus short-circuiting of turns of the helix. It is emphasized that (a) overprinting is especially intolerable where the elongated strip of film (forming the pattern) is narrow, and (b) narrow strips are often highly desirable, for example to increase resistance. Overprinting is also especially intolerable where the narrow strips are caused to be close together, to minimize inductance and to mimimize the size of the resistor.

A very important consideration in the manufacture of film-type resistors is the degree of utilization of the available surface area. This is especially true in the small-diameter "toothpick" size resistors, it being noted that the circumference of such a resistor is often less than 200 thousandths of an inch. If the gap between the printed portions of such resistors were large, such as close to 100 thousandths of an inch, only 50 percent of the surface area would be available for film-coating.

Silk-screening is (as mentioned above) particularly difficult to perform relative to solid ceramic cylindrical substrates, which are economical to manufacture by extrusion and centerless-grinding techniques, and which have highly superior qualities relative to strength and moisture resistance. Being solid, as distinguished from tubular, such substrates may not be put on spindles and thus "driven" and held in place. Of course, cylindrical substrates having diameters in the toothpick range may not practically be hollow, or spindled, since they would be largely unacceptable for various reasons notably including strength.

In summary, there exists a major need for a practical, economical apparatus which will take solid ceramic cylinders of various sizes, including toothpick diameter, and in a few seconds silk-screen thereon a metered amount of resistive film in numerous desired patterns including noninductive ones. The apparatus must be such as to achieve a great degree of repeatability, with minimized rejects, and to achieve a high degree of surface area utilization. Loading and unloading must be fast and easy, and (very desirably) each machine should be quickly convertible to make different sizes of parts.

SUMMARY OF THE INVENTION

The present invention (and that of the cited U.S. Pat. No. 3,880,609) has numerous method and apparatus aspects some of which will now be indicated briefly. These aspects relate to the following discoveries:

a. That high-precision but cheaply-formed solid cylinders of ceramic, which have very favorable characteristics relative to important factors including strength and moisture resistance, may be rapidly silk-screened with resistive material by supporting them at their ends, in a certain manner, and letting them be rotated in response to screen movement. This is true even of extremely small-diameter cylinders, the diameters of which are less than that of many toothpicks.

b. That a highly noninductive line-type serpentine pattern of resistive material is vastly superior to conventional helical patterns and is particularly susceptible to the silk-screening process, especially since there is a gap for the full length of the cylinder which makes it unnecessary for there to be any overlapping of the lines. Not only is the pattern noninductive, but the "feathered" cross-sectional shape of the silk-screened line results (particularly in contrast to helically-ground resistors) in benefits relative to such factors as prevention of voltage breakdown. The silk-screened line is also very advantageous in that its thickness can be "metered" by the screen to within plus or minus 5 percent, with resulting minimization of expensive finishing or resistance "trimming" steps.

c. That the apparatus should have smooth and substantially vertical lift-off of the squeegee, while the screen is stopped and the squeegee is registered at the gap in non-inductive film pattern, in order to minimize smearing and other adverse effects. Since the squeegee lifts off while at a gap in the pattern on the silk-screen, there is a minimum tendency for the ink to interfere with separation of the screen from the unspindled cylinder.

d. That separation of very small unspindled cylinders from the screen is facilitated —with no adverse side effects —by means of an air blast of predetermined characteristics. This air blast also produces great benefits relative to solid coats of silk-screened material, since there is then no gap in the screen pattern when separation is attempted.

e. That the ends of the screened line may extend substantially to the cylinder ends for maximized termination efficiency, if such lines are the very last things screened onto each cylinder.

f. That, particularly with small-diameter cylinders and non-inductive serpentine patterns, the squeegee edge should be firmly supported so that its location will not vary, this being one of numerous factors permitting achievement of a high degree of surface area utilization and a high degree of repeatability.

g. That the squeegee and flood arms of the screening apparatus are advantageously incorporated in an adjustable compound lever system, which achieves not only simplicity but also smoothness and effectiveness of operation.

h. That the same machine may be quickly and easily changed from one diameter (or length) of cylinder to another diameter thereof, by substituting one preset carriage for another, such carriage also resulting in simple and easy loading and unloading at each part.

BRIEF DESCRIPTION OF THE DRAWINGS:

FIG. 6 is an isometric view illustrating, in an open and nonoperating condition, certain components of the silk-screening apparatus;

FIG. 6*a* is a fragmentary plan view illustrating the support means for each end of the cylindrical substrate;

FIG. 7 is an isometric view showing the apparatus in operating condition;

FIG. 13 is a greatly enlarged vertical sectional view showing the shape of the squeegee, and its relationship to the cylinder, the parts again being shown during the actual screening step;

FIG. 14 is greatly enlarged schematic view illustrating the air-jet release of the screened cylinder;

FIG. 15 is an enlarged isometric view of the air nozzle; and

FIG. 16 is a simplified schematic representation of the control system.

DETAILED DESCRIPTION OF EMBODIMENTS

Figure 1:
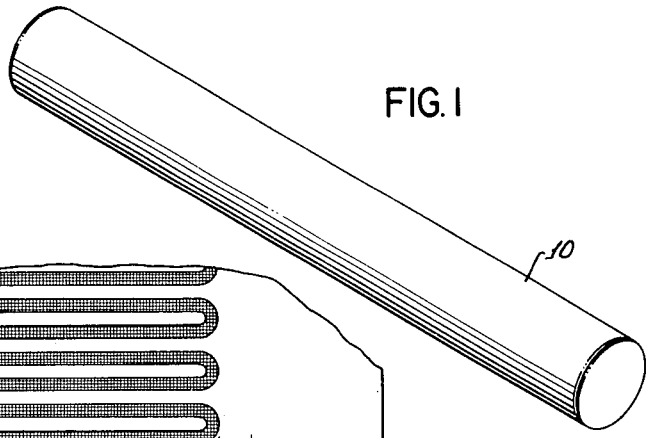
FIG. 1 is an isometric view showing the solid cylindrical substrate on which the resistive film is screened.

Referring first to FIGS. 1–5, the method (claimed in said U.S. Pat. No. 3,880,609) comprises providing an elongated cylinder 10 formed (for example, by extrusion) of a desired heat resistant substrate such as aluminum oxide ceramic. The exterior cylindrical surface of the cylinder 10 is caused, preferably by use of centerless grinding techniques, to be smooth and very round. The illustrated cylinder has a diameter "D" as shown at the left in FIG. 2.

As illustrated, the cylinder is solid, not hollow, and is not indented, recessed or stepped at the ends thereof. This creates substantial savings in production costs, and eliminates any possibility of moisture intrusion through the hollow center of a tube.

As the next step in the method, a resistive film 11 (FIG. 3) is silk-screened onto the exterior of cylinder 10 at major regions thereof, but not at the longitudinal gap 13. Such screening is effected rapidly, and is to be distinguished from the progressive "drawing" of a helical pattern on the surface as was done, for example, by the apparatus disclosed in the above-cited U.S. Pat. No. 1,857,769.

The silk-screening is effected by causing rolling contact to occur between a screen 30 (FIG. 2) and the cylindrical surface of cylinder 10. The screen 30 has a pattern area provided thereon and which is related to the diameter of cylinder 10 as described below. The rolling contact which takes place between cylinder 10 and screen 30 is straight-line contact, being along a line parallel to the axis of cylinder 10. There is not sliding contact between the member 30 and the cylinder, and there is (except for a different type of screen pattern, as expressly stated below) no overlapping of resistive material screened onto the cylinder.

Stated more specifically, the screen 30 has an impervious portion 31 and a pervious (pattern) portion 32. The shape, dimensions, etc., of previous portion 32 correspond to those of the desired resistive film pattern except that, in the illustrated apparatus, the previous portion 32 is planar. The dimension of previous portion 32 in the direction of screen movement is "X", and is equal to $\pi$ times D minus the width of the gap 13.

Figure 3:
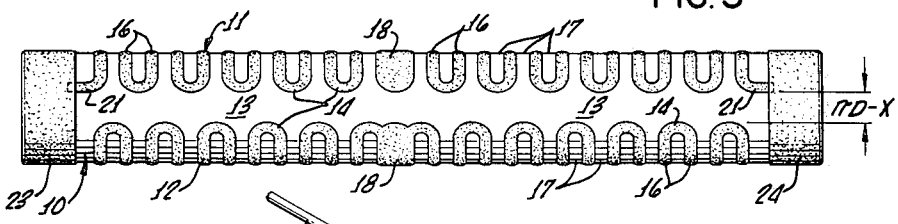
FIG. 3 is a plan view showing the resistor after the resistive film pattern has been printed thereon, and after terminal films have been printed at the ends of the cylinder.

The pattern or pervious portion 32 has, very preferably, the serpentine shape illustrated, and comprises an elongated strip or line which makes the corresponding strip or line 12 on the substrate (FIG. 3). Such line 12 comprises a multiplicity of series-related hairpin-shaped portions each having a U-shaped base (turn or bend) 14 and also having parallel arms 16. Adjacent ones of arms 16 pass current in opposite directions, the result being that the generated magnetic fields efficiently neutralize each other to prevent the creation of substantial inductance in the resistor.

The width of strip or line 12, that is to say the width of each arm 16 and each base 14, is small. The range may be between about 8 thousandths of an inch and about 100 thousandths of an inch. It is possible to have widths less than 8 thousandths, but this may interfere with production speed and repeatability.

In the illustrated embodiment, the serpentine wave forming the resistive film pattern is wrapped around the cylindrical surface of cylinder 10, in such manner that the U-shaped bases 14 are disposed adjacent each other on opposite sides of gap 13. Stated otherwise, there are two parallel rows of bases 14, one row on each side of gap 13. The arms 16 thus extend circumferentially of the cylindrical surface, whereas at least portions of the bases 14 extend longitudinally thereof.

With the described construction, each arm 16 is relatively short, being substantially less than the circumference of cylinder 10. Because of the short lengths of the arms 16 in the illustrated embodiment, the voltage drop along any arm is insufficiently great to create a large voltage differential relative to the adjacent arm, so that the tendency toward voltage breakdown is minimized.

In the illustrated embodiment, and in many preferred embodiments, the width of each arm 16 is substantially the same as the width of each space or gap between adjacent arms. Such spaces are illustrated, for example, at 17 in FIG. 3. The widths of spaces 17 may range from about 8 thousandths of an inch to about 100 thousandths of an inch, preferably much closer to 8 thousandths in order to mimimize inductance.

The thickness of strip 12 (as distinguished from the width thereof) is preferably between about ½ thousandth and about 2 thousandths of an inch at its maximum dimension. Such thickness is measured in a direction radial to the axis of the substrate. It is pointed out that, as described in parent application Ser. No. 315,018, the exterior surfaces of the edge portions of strip 12 taper (converge) toward the cylindrical surface, so that there is no sharp corner or dropoff point. This "feathered" shape tends to minimize the possiblity of voltage breakdown.

The silk-screen apparatus further comprises a squeegee 33 which is supported by means described below. The squeegee engages the upper surface of silk screen 30 above the upper region of cylinder 10, the region of the screen engaged by the squeegee being in straight-line contact with the cylinder along a line parallel to the cylinder axis. Means (described below) are provided to rotatably support the extreme ends of cylinder 10 in such manner that the cylinder will rotate with the screen as the latter is moved beneath the squeegee 33.

In performing the silk-screening operation, a suitable flood or wiper member (described below) is provided to move across the upper surface of screen 30 and impregnate all of the previous portion 32 with resistive material, preferably a complex oxide resistive material. Such resistive material forming film 11 comprises electrically conductive complex metal oxides in a glass matrix, and which are fired in air (for example, for thirty minutes) at temperatures above 1400° F. To permit the complex oxides and glass particles to be silk-screened, they are first mixed with a pine oil (squeegee oil) vehicle. Another resistive material which may be employed is carbon particles, in an epoxy vehicle which also acts as an adhesive or binder.

Thereafter, screen 30 is moved to the left (as viewed in FIG. 2) beneath squeegee 33, the amount of movement being such that each portion of the pattern area of the silk screen 30 (namely, the pervious portion 32 of the silk screen) engages cylinder 10 once and only once.

Figure 2:
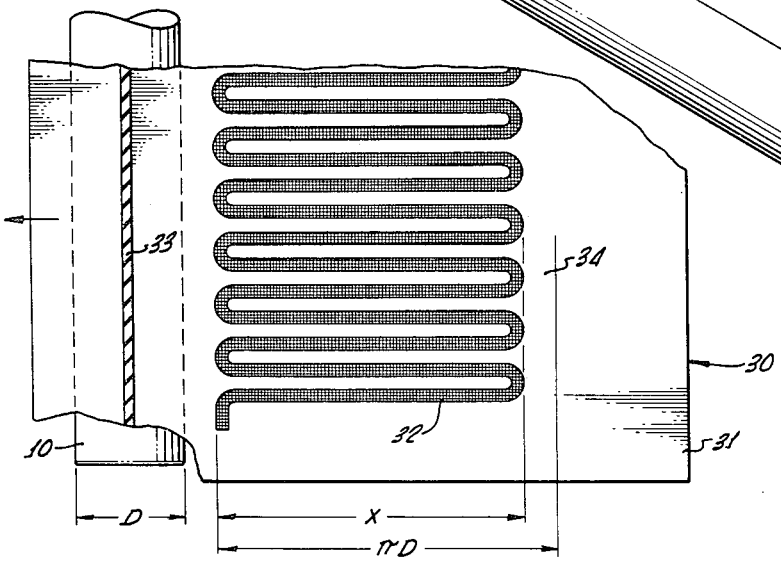
FIG. 2 is a top plan view showing schematically a silk-screen apparatus employed to manufacture the present resistor.

Thus, where the pervious portion 32 of silk screen 30 has a dimension "X" in the direction of movement of screen 30, the amount of screen movement which is caused to occur after the most advanced (forward) portion of the pattern area engages squeegee 33 is greater than X but less than $\pi$ times D. Accordingly, at the completion of the leftward (FIG. 2) printing stroke of screen 30, the screen region indicated at 34 in FIG. 2 is beneath squeegee 33. Such region 34 corresponds to the longitudinal gap 13, as shown in FIG. 3, which gap has a width equal to $\pi$ times D minus X.

Region 34, and thus gap 13, should each have a width of at least 0.015 inch. The width of the gap should not be very much wider than 0.025 inch because it would constitute a waste of the surface area of the substrate.

After completion of the screening stroke, the screened cylinder 10 is removed so that it no longer contacts screen 30. Thereafter, screen 30 is moved in the reverse direction (to the right as viewed in FIG. 2) and, at the same time, the flood or wiper means causes wiping of a new amount of resistive material into the pervious portion 32 of the screen. Thus, the apparatus is ready for the next screening stroke.

The coated cylinder 10 is then fired in air, in a furnace, at temperatures in excess of 1400° F., in order to effect melting of the glass and curing of the resistive material. Such firing is continued for 30 minutes.

Thereafter, cylindrical films 23 and 24 (FIG. 3) of highly conductive termination material (preferably a silver-ceramic material in a glass matrix or, less desirably, a silver-epoxy conductive plastic) are provided at opposite ends of the cylinder and over terminal portions 21 (FIG. 3) of the resistive film. The cylinders are then again fired, for (for example) 5 minutes at 1100° F.

Figure 4:
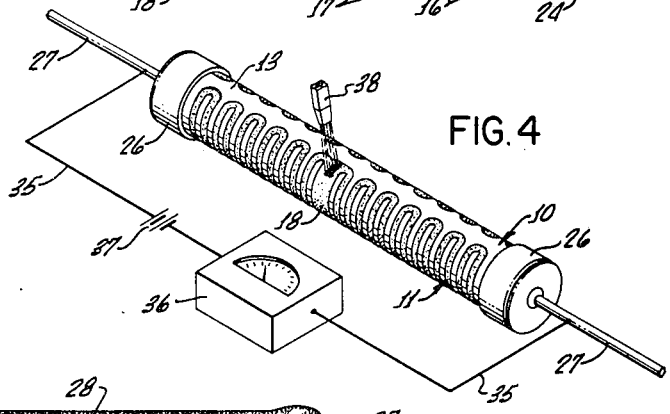
FIG. 4 is an isometric view illustrating one manner of accurately adjusting the resistance value of the resistor.

As the next step in the method, end caps 26 (FIG. 4) are press fit over the films 23 and 24, and the associated leads 27 are electrically connected to leads 35 shown in FIG. 4 and which are part of a resistance testing device. Such device further comprises an ohmmeter 36 and a power source 37. When power is applied from source 37, the meter 36 indicates the resistance of the resistive film pattern in the resistor being tested.

In production, the as-formed resistive film is caused to have a resistance slightly less than the desired final resistance. (Because of the use of the present silk-screen process, the resistance variation in the as-formed film can be kept within plus or minus 5 percent.) Thereafter, the resistance of the film is increased until the meter 36 reads the desired value. Such increase may be effected in different ways, the illustrated one being to direct from nozzle 38 (FIG. 4) a high-velocity blast of abrasive material, the blast being localized in a wide portion 18 of the pattern. The result of the blast is to abrade away the resistive material and therefore increase the length of the path through which the current must flow in passing between the ends of the cylinder. As the current path length is thus increased, the resistance of the resistive element increases until the meter 36 reads the desired value, following which the abrasive blast is terminated.

Another method of adjusting the resistance is to abrade away, as by a grinding or lapping operation, the entire exterior of the resistive film 11, the amount of such grinding being only very little but being sufficient to cause the film to be somewhat thinner than before. The degree of thinning is made sufficient to raise the resistance until the meter 36 reads as desired.

Because of the plus or minus 5 percent control achieved by the present silk-screen process, the time required by these final resistance-trimming steps is minimized.

Figure 5:
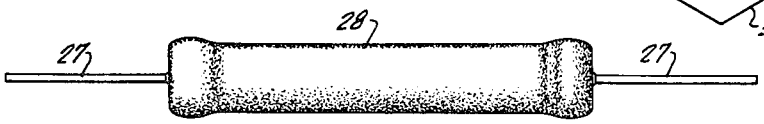
FIG. 5 is a side elevational view of the completed resistor having the protective coating thereon.

As the final step in the method, an environmentally protective coating 28 is provided, as by spraying or dipping, to result in the finished product shown in elevation in FIG. 5. Such environmentally protective coating 28 (encapsulating means) is formed of a suitable material having the requisite characteristics relative to insulating ability, moisture resistance, heat resistance, etc. A preferred coating material is silicone conformal, which may be purchased from Midland Industrial Finishes Company, of Waukegan, Illinois.

As an example of one resistor formed by the present process, the cylindrical substrate 10 may be 0.060 inch in diameter, which is smaller than many toothpicks. Its length may be, for example, 15/16 inch. The width of line 12 (FIG. 3), and the gap width 17 between each two adjacent arm portions 16, may each be 0.008 inch. The width of gap 13 is approximately 0.020 inch.

FURTHER DESCRIPTION OF THE METHOD AND APPARATUS, PARTICULARLY RELATIVE TO FIGS. 6 ET. SEQ.

Referring particularly to FIGS. 6 and 7, the silk-screening apparatus comprises a base plate 40 having track elements 41 along the longitudinal edges thereof. A squeegee arm 42 is pivotally connected to brackets 43 at one end of the plate 40, and extends toward the other end of such plate. Pivotally connected to squeegee arm 42 is a flood-bar arm 44. The arms 42 and 44 form, in cooperation with fulcrum and adjustment means described below, a compound lever system.

The "silk screen", which is actually preferably formed of stainless steel or polyester, has a frame 48 (FIG. 7) which is, in turn, secured by pivoted retainer members 49 in a rolling frame 51. The latter frame has wheels 52 mounted in grooves 53 in tracks 41. The silk screen is numbered 30*a* since it is preferably the type shown in FIG. 12 instead of FIG. 2.

A part carriage 54 is movable mounted on base plate 40 for sliding movement beneath screen 30*a*. The cylindrical ceramic part (substrate) 10 is rotatably supported in a certain manner (described below) on carriage 54, and is screened when the apparatus is generally in the condition shown in FIG. 7.

The actual silk-screening of the cylindrical part 10, and the screen-flooding stop which precedes such actual silk-screening, occur in response to movement of screen 30*a* inwardly and outwardly between precisely-predetermined positions controlled by stop means described below. The position of the compound lever system determines whether a particular stroke of screen 30*a* causes silk-screening or screen-flooding.

To operate the lever system, a pneumatic cylinder 56 is mounted on base plate 40 beneath the squeegee arm 42. Periodically, for example when the apparatus is being converted for printing of a different size of part 10, the lever system is precisely adjusted. Primarily, this adjustment is effected by a screw 57 which determines squeegee pressure against the screen 30*a*. Additionally, adjustment is effected by fulcrum elements 58 associated with the flood-bar arm 44.

The apparatus additionally comprises air-jet means including an air nozzle 59. This performs important separation functions relative to small-diameter parts, and relative to those parts which are secured about their full circumferences.

Proceeding next to a detailed description of the above-mentioned (and other) elements, the squeegee arm 42 comprises side members 61 and a top member 62 cooperatively forming an inverted channel. A weight 63 (FIGS. 8 and 9) is mounted in the channel at the end of the squeegee arm remote from the pivot pin 64 by which the squeegee arm connects to brackets 43, such weight assuring that adequate squeegee pressure is brought to bear on the screen 30*a*.

Secured at the extreme outer end of squeegee arm 42, remote from pivot pin 64, is a squeegee assembly comprising an upper plate 66 which is fixedly secured to an end member 67 at the outer end of the arm. First and second side plates 68 and 69 are fixedly secured to the lower region of upper plate 66, and clamp therebetween a squeegee element 71 formed of a relatively stiff elastomeric material. The side plates 68–69 extend downwardly to regions relatively adjacent the screen 30*a*, in order to laterally support the squeegee element 71 and thus maintain the working edge 72 (FIG. 13) thereof in a precise predetermined position.

As best shown in FIG. 13, the working edge 72 is the lower edge remote from pivot pin 64, being the front edge of the lower face 73 of the squeegee. Such lower face is inclined from the horizontal at only a relatively small angle, for example 10°–15°, the result being that the entire width of the squeegee operates to support and position the working edge 72. The squeegee element 71 is relatively thick, for example approximately $\frac{3}{8}$ inch thick, in order to further support the working edge 72 instead of permitting the same to move.

The described precise positioning of edge 72 is important in order to insure that, particularly for the noninductive type of resistor described above and having the small gap 13 (FIG. 3), the squeegee edge 72 will be located at such gap at the end of the screening stroke. The reason for this was described above relative to portion 34 of the screen 30, FIG. 2.

Referring next to the flood-bar arm 44, this comprises a pair of side members 75 mounted outwardly adjacent side members 61 of the squeegee arm, and pivotally associated with such last-mentioned outer members by means of a pivot pin 76. The outer ends of side members 75 bend downwardly and are fixedly connected to a flood bar 77. Bar 77, which is preferably formed of a plastic such as "Teflon", has an inclined lower face 78 terminating in a horizontal edge 79. The horizontal edge 79 is relatively adjacent the squeegee element 71. Conversely, the working edge 72 of the squeegee is relatively adjacent the flood bar 77.

Especially at the end of the inward (to the right as viewed in FIGS. 8–11, 12 and 13) screening stroke of the screen 30*a*, as distinguished from the outward flooding stroke, it is important that the screen position be precisely predetermined. This is accomplished by means of a stop bar 84 which is fixed on base plate 40 and is adapted to be engaged by a member 85 fixed to the lower side of the screen frame 51. The member 85 also actuates, at approximately the end of the screening stroke, a limit switch 86 the function of which is described subsequently relative to FIG. 16.

The positions of elements 84–85 are so correlated to the position of the pervious pattern on silk-screen 30*a*, to the position of squeegee edge 72, and to the inner position of carriage 54, that the squeegee edge 72 will be registered with gap 13 (FIG. 3) in the screened part at the end of the inward screening stroke.

Conversely, and in order to limit the outward (to the left as viewed in FIGS. 8–11) movement of the screen assembly, which is the direction of movement which occurs during flooding of the screen, a stop bar 81 is mounted at the outer region of base plate 40. Such bar is engaged by a member 82 on the screen frame 51, the latter member also operating a limit switch 83. The limit switches 83–86 are fixedly mounted, respectively, adjacent the stop bars 81–84.

Referring next to the part carriage 54, it should first be noted that there is preferably a different size of part carriage for each length and diameter of ceramic cylinder 10. Thus, for example, when a part of smaller diameter is to be screened, it is supported at a higher elevation than that at which a part of larger diameter is supported. Since each and every part carriage 54 is preset for a particular diameter and length of part 10, there can be extremely fast and simple conversion from screening of one size of cylinder to another size thereof.

Referring particularly to FIGS. 6 and 6*a*, the illustrated carriage 54 comprises a U-shaped (or channel-shaped) base 87 which is mounted on a slide plate 88. Plate 88 is slidably supported on base plate 40, and is guided by opposed tracks or rails 89 on such base plate.

A pair of ball-bearing assemblies 91 is mounted (with horizontal axes which are parallel to the axis of part 10) on the inner sides of the upper flange portions of base 87, to support the extreme end regions of the part. Such end regions do not extend clear to the inner surfaces of the flanges of base 87, but (as shown in FIG. 6*a*) only to the midregion of each ball-bearing assembly 91. To locate the part 10 with precision, a pair of centralizing or thrust-bearing elements 92 (FIG. 6*a*) is mounted on the flanges of base 87, for example by screws 93 which extend into the upper surfaces of such flanges. The illustrated elements 92 are tear-drop shaped and have pointed ends which engage the opposite ends of each part 10 at the axis thereof.

The described cylinder-supporting and positioning elements of part carriage 54 permit rotation of the cylinder 10 with only a small amount of friction. The friction is sufficiently small that the cylinder will be rotated in response to shifting of the silk screen 30*a*.

By employing the described cylinder-supporting means, applicant is enabled to silk screen even extremely small-diameter parts with great precision and without the necessity of any driving of the part (other than by the screen). Since each cylinder or part 10 is only supported from beneath, not spindled or connected to any element for driving purposes, it is extremely simple to load and unload each part when the part carriage 54 is in its outermost position as described below relative to FIG. 11.

The innermost or working position of the part carriage 54 must be determined with great precision. Thus, for each diameter of part 10, the innermost position must be such that (for the described noninductive serpentine patterns) the part will rotate slightly less than one revolution during the time period that the screen pattern is registered therewith, and prior to the time that the inward (rightward) movement of the screen is stopped by the stop element 84. Since the part thus rotates slightly less than one full revolution during the time period that the screen pattern is adjacent thereto, the part stops rotating when squeegee edge 72 is registered with the gap 13 as described above.

The inner or working position of the part carriage is determined by an adjustable stop element in the form of a screw 94 which is threaded into slide plate 88 and is adapted to engage a stop block 95 mounted on base plate 40. The carriage 54 for each size of cylinder 10 has its own screw 94, and such screw is so adjusted that the associated part 10 will be in the precise working position desired at the time that the screw engages the block 95.

It is pointed out that the amount of travel of the screen assembly is that which is required by the largest diameter of cylinder 10 which the particular size of silk-screening apparatus is adapted to screen. This means that, for the largest diameter parts, the screening operation will start to commence (that is to say, the pervious or pattern portion of the screen will be moved into contact with the cylindrical surface of the part) almost immediately after the screen starts on its inward or silk-screening motion. However, for the smallest diameter cylinders 10 screened in the same machine, these will be rotated several times while they are in engagement with the impervious portion of the screen, and before the pervious pattern portion of the screen is reached. Such rotation while in engagement with the impervious portion of the screen is not detrimental, since no "ink" can penetrate to the cylindrical part surface during such pre-rotation of the part.

A handle 96 is mounted on the outer end of each slide plate 88 for grasping by the operator in order to move the carriage inwardly and outwardly. It is to be understood, however, that such actuation of the slide plate 88 may be effected by automatic means, if desired. Such automatic means may include an air cylinder, etc., controlled by a suitable control circuit such as the one schematically represented in FIG. 16.

There will next be described the compound lever system which is formed by the squeegee arm 42, the flood-bar arm 44, and the pivots for such arms. These pivots include not only pivot pins 64 and 76 but also the fulcrum elements 58. Elements 58 preferably comprise vertical screws which are threadedly inserted into a block 100 on base plate 40. The upper ends of the fulcrum screws 58 engage, respectively, the lower edges of the side members 75 of flood-bar arm 44.

Figure 8:
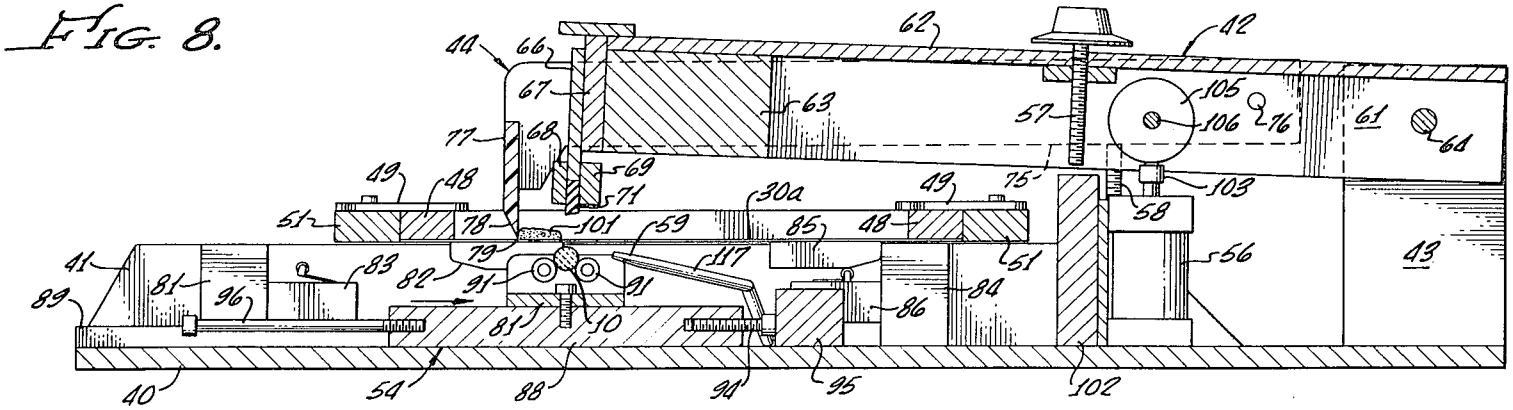
FIG. 8 is a longitudinal sectional view showing the positions of the parts just after a ceramic cylinder has been shifted into its predetermined position beneath the screen.

Referring to FIG. 8, the compound lever system is shown in one of its two positions, the one at which squeegee element 71 is elevated and flood bar 77 is lowered. As illustrated, the squeegee element 71 is then sufficiently high to be spaced above the mound of "ink" 101 on the upper surface of screen 30*a*. Such "ink" is, as previously described, actually the resistive material mixed with squeegee oil, and which has a somewhat thick or pasty consistency. The lower edge 79 of flood bar 77 is clear of the screen 30*a*, for example about 0.015 inch thereabove, but is disposed at a sufficiently low elevation that outward shifting of the screen assembly (to the left as viewed in FIG. 8) will cause flooding of the upper screen surface by the ink.

Figure 9:
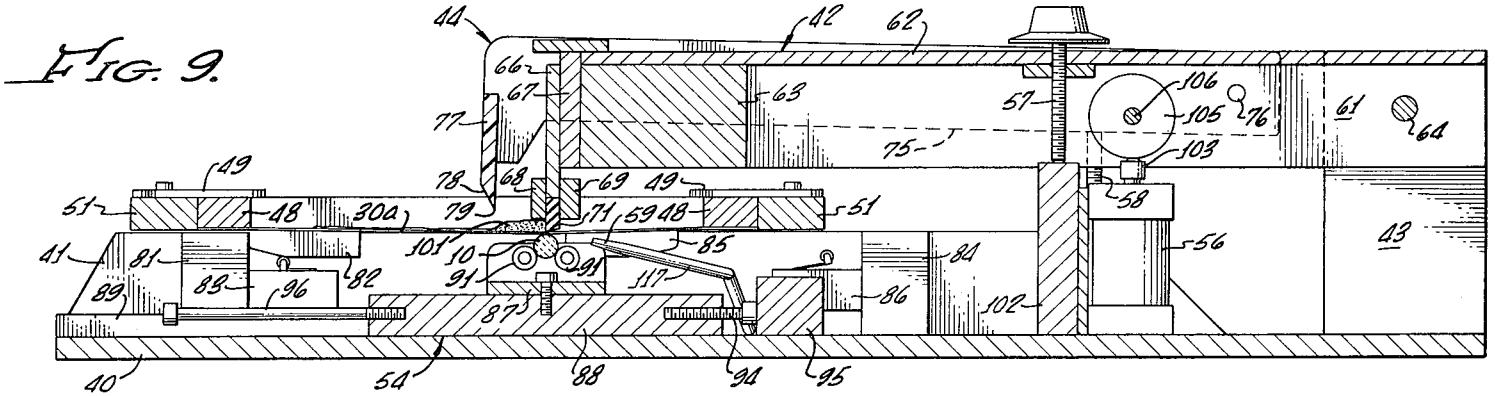
FIG. 9 is a corresponding view but showing the positions of the parts just after the end of the flood step.

FIG. 9 illustrates the compound lever system in its opposite position, the flood bar 77 then being lifted to a position far above the screen 30*a*. The lower or working edge 72 of the squeegee element 71 is then in pressure engagement with the screen 30*a*, in response to the weight of the squeegee arm 42 (including its weight element 63). Such pressure engagement causes downward deflection of the screen 30*a*.

It is to be noted that when the elements shift from the FIG. 8 condition to the FIG. 9 condition, the pivot pin 76 for the flood-bar arm 44 shift downwardly. Such downward shifting effects upward movement of the flood bar 77 due to the fulcrum action at the upper ends of fulcrum screws 58. The latter screws may be adjusted to achieve any desired elevation of the flood bar above the screen.

When the squeegee arm 42 is in its lower position, FIG. 9, the weight thereof is not supported entirely by the lower edge of squeegee 71 pressing on the screen (which in turn presses on the part 10 supported on rollers 91). This is because a major portion of the squeegee bar weight is borne by the adjustment screw 57 which determines squeegee pressure, the lower end of such screw resting (as shown in FIG. 9) on the upper end of a support block 102 mounted on base plate 40. The turning of the screw 57, by means of a calibrated knob (which is associated with a suitable scale on the upper surface of member 62) permits the operator to determine the exact amount of squeegee pressure and thus the precise amount of ink which passes through the screen and onto the part 10.

By so turning the screw 57 that a greater amount of weight is borne by the screen, a progressively greater amount of ink 101 is caused to pass through the screen and onto the part during each screening operation. As previously indicated, the ink is "metered" onto the screen in such manner that the resistance resulting from the screening operation may be maintained constant within plus or minus 5 percent.

Referring next to the pneumatic cylinder 56, which shifts the compound lever system between the extreme positions of FIGS. 8 and 9, this includes a piston element the upper end 103 of which is adapted to engage a roller 105 which is mounted in low-friction manner by means of a horizontal pin 106 extending between the side elements 61 of arm 42. Because the low-friction roller 105 is employed, there is no binding or other undesired action which may cause jerking of the parts during upward or downward movement of the lever system, which undesired movement may result in smearing or other adverse effects.

The pneumatic cylinder 56 has nothing to do with the critical lower position of the squeegee element 71 (FIG. 9), since such lower position is determined by the squeegee pressure screw 57. However, the less-critical upper position of the squeegee arm 42, and the corresponding lower position of the flood-bar arm 44, are determined by the upward stroke of the piston. The length of such upward stroke may be set by making a suitable adjustment at the element 56, in order to regulate the spacing between the lower edge of flood bar 77 and the upper surface of the screen.

Referring next to FIG. 16, air is supplied to the pneumatic cylinder 56 from an air pressure source 107 through a throttle element 108 and an electrically operated shut-off valve 109. Another throttle element 111, and another electrically operated shut-off valve 112, are provided in a vent line from the cylinder 56.

When valve 109 is open and valve 112 closed, air from source 107 passes at a predetermined metered rate through throttle element 108 to the cylinder, thus effecting upward movement of the upper end 103 of the piston to a predetermined upper position corresponding to that of FIG. 8. The rate of upward movement is caused to be relatively slow in order that there will be no jerking or vibration of the various elements, with resulting possible smearing. When valve 109 is closed and valve 112 open, air escapes from the cylinder 56 through throttle element 111 and vents to atmosphere. Element 111 restricts the outflow of air to a rate sufficiently slow to insure against undesired vibrations and jerking. Downward movement of the lever system (namely, the squeegee arm 42) is then effected, by gravity, to the position of FIG. 9.

Figure 10:
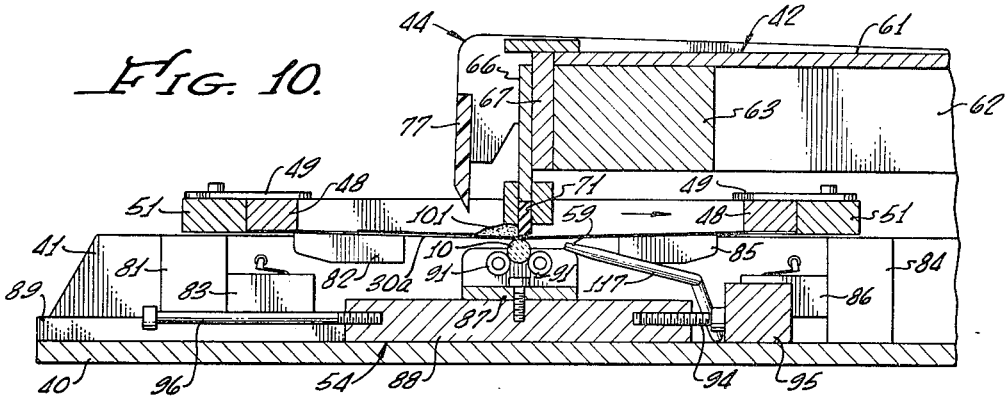
FIG. 10 illustrates the motion of the screen during the actual screen-printing step.

The electrically-operated valves 109 and 112 are connected to a suitable electrical control circuit 113 which is operated in response to the previously-described limit switches 83 and 86, each of which is a normally-open switch. Control circuit 113 operates as follows:

a. When limit switch 86 is closed and limit switch 83 is open, which is the case when the screen assembly is in the inward (right) position of FIG. 8, then valve 109 is open and valve 112 is closed. The cylinder 56 is thus pressurized to maintain the piston end 103 upwardly, causing the lever system to be in the FIG. 8 position with the squeegee element 71 elevated and the flood bar 77 depressed.

b. When the screen assembly is then moved to the left, away from the position of FIG. 8, the control circuit 113 nevertheless maintains valve 109 open and valve 112 closed until the screen reaches its extreme outermost (leftward) position of FIG. 9, to thus close the limit switch 83. At this time, the control circuit 113 causes valve 109 to close and valve 112 to open, thus venting cylinder 56 and permitting the lever system (squeegee arm) to shift to its lowermost position in response to gravity. The squeegee element 71 then rests on the screen **30*a*, and the flood bar 77 is elevated, as shown in FIG. 9**.

c. While the screen assembly is moved inwardly (to the right) as shown in FIG. 10, the control circuit 113 maintains valve 109 closed and valve 112 open, until the extreme inner (rightward) screen position is achieved and the limit switch 86 is closed. The parts then assume the position of FIG. 8, as described above in subparagraph (a).

To speed up the operation, each limit switch may be set to initiate air flow slightly before the end of the screen stroke. This is because the throttles delay any squeegee movement until the screen is at a dead stop.

SUMMARY OF THE METHOD, FOR EXAMPLE EMPLOYING THE APPARATUS AS THUS FAR DESCRIBED RELATIVE TO FIGS. 6 ET. SEQ.

The method will be described employing the preferred screen **30*a* shown in FIG. 12. With only two exceptions, this screen is identical to the screen 30 described above relative to FIG. 2. The exceptions are as follows: (a) The ends 114 of the serpentine screen pattern 32*a* (pervious portion 32*a*) are much longer than are the corresponding ends shown in FIG. 2, preferably extending at least to the end of the cylinder 10. (b) Such ends 114 are on the portion of the screen which is most remote from the squeegee element 71 prior to the screening stroke, whereas in FIG. 2 such ends are on the portion then closest to the associated squeegee 33**.

Figure 12:
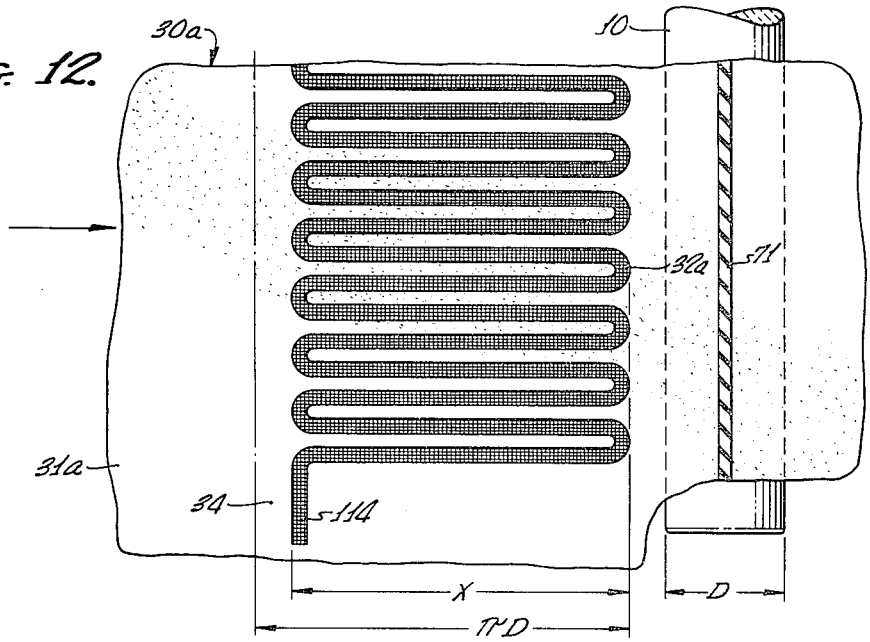
FIG. 12 corresponds generally to FIG. 2 but shows a different and preferred embodiment of the screen for printing a non-inductive pattern onto the substrate, the screen being shown as moving correspondingly to FIG. 10.

It is to be understood that although only one end 114 is shown in FIG. 12, there is an identical end corresponding to the other end (not shown) of the cylinder 10. Stated otherwise, there are two aligned ends 114, both of which extend axially of the cylinder, both of which are on the pattern portion most remote from the squeegee 71.

It is also to be understood that the statements made above relative to FIG. 2, and concerning the relationships between "X", "$\pi$D", and "D", apply equally to the method relative to FIG. 12 as to the method relative to FIG. 2. Thus, there is a space 34 in FIG. 12 which corresponds to that in FIG. 2, and which also corresponds to the gap 13 in the finished silk-screened coating (FIG. 3).

Let it first be assumed that a cylinder 10 has been mounted in the carriage 54 as described above, and that the carriage has been shifted inwardly (rightwardly) to the predetermined working position shown in FIG. 8. Let it also be assumed that the compound lever system (squeegee arm 42) is in its elevated condition, the flood bar 77 being down and the squeegee element 71 being up. Furthermore, it is to be assumed that the upper surface of the screen **30*a*** has been supplied with "ink" (the above-indicated resistive material mixed with squeegee oil).

The operator then rapidly shifts the screen assembly all the way to the left, to the outer position shown in FIG. 9. This movement, which requires only about a second or less, causes the flood bar (although its lower edge is spaced a slight distance above the screen 30*a*) to spread the ink 101 over the pervious portion 32*a* of the screen 30*a*. During this motion, the squeegee 71 is maintained elevated so far above the screen 30*a* that it cannot effect any coating action relative to the part 10.

As soon as the screen assembly reaches the position of FIG. 9, element 82 closes limit switch 83 and causes cylinder 56 to shift the compound lever assembly to its position of FIG. 9, squeegee 71 then being down and flood bar 77 being up. The lower working edge 72 (FIG. 13) of the squeegee 71 then causes downward deflection of the screen 30*a* by an amount determined by the squeegee pressure screw 57. Advantageously, this amount of screen deflection is about 0.015 inch. The flood bar 77 is then sufficiently far above the ink 101 that is cannot create any deleterious effects.

Figure 11:
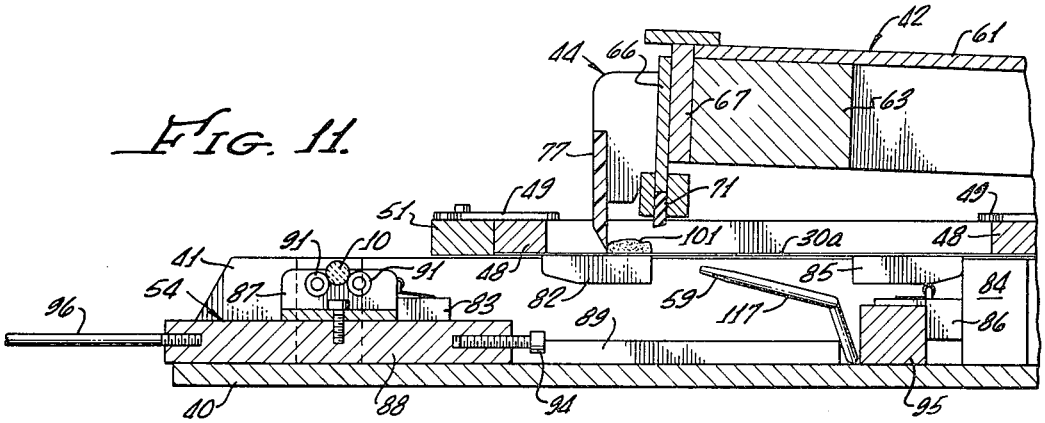
FIG. 11 shows the positions of the parts during unloading and loading of a cylinder relative to the carriage.

The operator then rapidly pushes the screen assembly all the way rightwardly to the inner position of FIGS. 8 and 11. Referring to FIG. 10, which shows an intermediate portion of such inward shifting of the screen assembly, and also referring to FIGS. 12 and 13 which illustrate what occurs during such screening step, it is to be noted that the part 10 is initially in contact with an impervious portion 31*a* of the screen. The frictional engagement between such portion 31*a* and the external cylindrical surface of part 10 causes the part to rotate clockwise, as viewed in FIG. 13. Although the part is then directly beneath the lower edge 72 of squeegee element 71, there is no coating taking place due to the impervious nature of the screen portion 31*a*.

The instant that the leading edge of the pattern or pervious portion 32*a* (FIG. 12) of the screen 30*a* reaches the working edge 72 of squeegee 71, screening starts to occur. Thereafter, while the part 10 rotates slightly less than one full revolution due to frictional engagement with the moving screen, the full pattern (preferably, the illustrated noninductive serpentine pattern) of pervious portion 32*a* is screened onto the cylinder. The "ink" is metered through the screen in an amount determined largely by squeegee pressure which in turn is controlled by the squeegee pressure screw 57, so that the resulting silk-screen part will have the requisite resistance within close limits.

Although FIG. 13 shows edge 72 as directly above the axis of part 10, it is often advantageous to position carriage 54 so that the axis of part 10 is a slight distance to the left of the position shown in FIG. 13.

The last screen portions which pass beneath the squeegee edge 72 are the end portions 114 (FIG. 12) which extend clear to (or close to) the opposite ends of cylinder 10. Because of the relationships described above, as soon as these portions 114 pass all the way beneath the squeegee edge 72, screen motion is stopped due to engagement of element 85 with stop bar 84, so that no further screening can occur. Engagement of limit switch 86 by element 85 causes the compound lever assembly to shift back to its FIG. 8 condition, also shown in FIG. 11, so that squeegee 71 is lifted above the screen 30*a*. Furthermore, the screen 30*a* —since it no longer bears weight—springs up to its horizontal condition shown in FIGS. 8 and 11.

It is to be noted that rotation of the cylinder 10 is stopped by the braking action effected between screen 30*a* and the cylinder as soon as the element 85 engages stop bar 84. It follows that, even though the screen 30*a* lifts until it is spaced away from the cylinder 10, the latter is not then rotating and therefore will not turn on the low-friction ball bearings. This is important, because if the cylinder were to rotate even less than half a revolution, the pattern end portions (which correspond to ends 21 as shown in FIG. 3, except that they extend to the ends of the cylinder) would engage the rollers 91 (FIGS. 6 and 6*a*) and be smeared.

As the next step in the method, the operator pulls on handle 96 to shift the part carriage 54 outwardly to the load-unload position of FIG. 11. The screened part 10 is then removed and placed in a drying rack, whereas a new unscreen part is positioned in the carriage. The carriage 54 is then shifted inwardly to the FIG. 8 position, after which the above-described operations are repeated relative to the new part. The entire screening cycle takes only a few seconds.

The silk-screened parts are then fired as described above, following which the ends thereof are covered with conductive films corresponding to those 23–24 shown in FIG. 3, following which such films are baked as described above. The resistance value is then "trimmed", for example as described relative to FIG. 4 but preferably by abrading the entire exterior cylindrical surface of the resistor (other than at the end films 23–24). Because of the accurate nature of the silk-screening step, this final abrading step is of minimum duration. As the final step in the method, the resulting resistor is coated with a material 28 as stated above relative to FIG. 5.

Because of the fact that the silk-screened end portions of the resistive film pattern, corresponding to pattern portions one of which is shown at 114 in FIG. 12, extend to the ends of the cylinder 10, the electrical connections to end films 23–24 are much more satisfactory relative to the embodiment of FIG. 12 than relative to the embodiment of FIG. 2. It is also possible (but less satisfactory) for some applications, to mount the end caps 26 (FIG. 4) directly over the ends of the resistor, without employing the conductive films 23–24.

As previously noted, converting to another part is effected by changing to another carriage 54 specifically designed for such part. The height of the part carriage, the adjustment of the stop screw 94 thereof, etc., are so correlated to the screen employed for the new part that changeover occurs rapidly. To change the screen for the new part, it is merely necessary to pivot back the elements 49 and replace one screen for another. The only other thing which is then required is to adjust the squeegee pressure, which is effected by squeegee pressure screw 57.

The "ink" 101 is advantageously applied by merely pivoting the arms 44–42 upwardly, for example to the position of FIG. 6, and then applying new ink to the upper surface of screen 30*a* (which is not shown in FIG. 6), following which the arms are pivoted downwardly to the working positions of FIG. 7.

DESCRIPTION OF THE AIR-BLAST METHOD AND APPARATUS

It may occur that very small-diameter cylindrical resistances, immediately after being coated in response to the screen-printing step described above relative to FIG. 10, tend to adhere to the under surface of the screen 30*a*. Thus, when the squeegee 71 is shifted to its upper position (FIGS. 8 and 11) which permits upward movement of the screen 30*a*, the small-diameter part may lift off the supporting rollers 91. The amount of such lifting is equal to the amount of downward deflection of screen 30*a* in response to lowering of the squeegee, and may (as above noted) be on the order of about 0.015 inch.

If, while a part is still adhering to the underside of screen 30*a*, the operator pulls on hanlde 96 to shift the part carriage 54 to its loading position of FIG. 11, smearing of various portions of the wet "ink" will result.

In addition to the described situation which relates to silk-screened resistors incorporating gaps such as the gap 13 (FIG. 3) in the illustrated noninductive pattern, there is another and major situation where the part 10 tends to adhere to the underside of screen 30*a*. This occurs when the present apparatus is employed to silk screen solid coats (such as the one shown at "C", FIG. 14) the full 360° of (or on major portions of) the surface area of the cylinder. Since such "solid-coat" resistors are not line-type resistors, a certain amount of overlapping (cylinder rotation for more than 360°) at the beginning and end of the printing stroke is permissible, whereas overlapping is not permissible in the noninductive line-type resistors. Because the indicated types of resistors are solid-coat, the pervious portion of the silk screen is registered with the squeegee 71 at the end of the printing stroke. This means that the "ink" often acts as an adhesive to cause the ceramic cylinder, even the larger diameters of such cylinders, to adhere to the underside of the screen when the screen elevates.

The present method and apparatus provide a simple and economical means and method for separating the silk-screened cylindrical resistors from the screen, both relative to the smaller diameters of noninductive (or other line-type) resistors, and relative to "solid-coat" resistors (and other resistors) where there is overlapping at the end of the screening stroke. This comprises the above-indicated air nozzle 59 which, as shown in FIG. 15, may consist of a tube 117 which is flattened and flared in order to provide a horizontally elongated nozzle opening 116. The tube 117 is suitably mounted in the apparatus at such a location that the opening 116 (FIG. 15) is horizontal and the nozzle 59 is inclined upwardly toward the space between the silk screen and the upper region of the cylinder 10 (the nozzle being also centered relative to the longitudinal dimension of cylinder 10).

Referring to FIG. 14, there may (particularly relative to solid-coat resistance coatings where there is overlapping) be a small ink region 118 between the screen and the upper part of the cylinder. This ink region causes the screened part ot lift off the rollers when the screen elevates. When pressurized air is directed through the nozzle 59, the air operates to sever effectively such ink region 118 and permit the cylinder 10 to drop onto rollers 91 so that it may be moved back to the load-unload station (FIG. 11) without smearing.

The pipe 117 incorporates therein an electrically-operated shut-off valve 119 (FIGS. 14 and 16) which controls the flow of air from an air pressure source 121 (FIG. 14). Suitable means, not shown, are provided to adjust the air pressure in the source in accordance with factors including the diameter of the cylinder 10 being screened. Thus, for the very small-diameter cylinders, the pressure of the air delivered to the nozzle 59 is frequently caused to be much lower than it is relative to the larger-diameter cylinders.

Referring to FIG. 16, the shut-off valve 119 is connected to the control circuit 113, and such circuit is caused to incorporate means to cause the valve 119 to open momentarily, and then close, immediately after the squeegee 71 separates from the screen. Thus, for example, the control circuit 113 may incorporate suitable time delay means which effects opening of valve 119 a sufficient time period after operation of limit switch 86 to insure that the screen has substantially completely raised in response to upward shifting of the squeegee element 71. Thereafter, at the end of a short time period, the control circuit causes the valve 119 to close and thus terminate the flow of air to nozzle 59.

ALTERNATIVE CONSTRUCTIONS AND METHODS

An alternative but generally much less desirable method of manufacturing resistors, using the silk-screen process, is to coat the entire exterior surface of cylinder 10 with resistive material. For example, there is vapor-deposited on the cylinder a coating of resistive metal such as a nickel-chromium alloy. Thereafter, the silk-screening process described above is employed to silk screen onto the vapor-deposited metal a pattern of acid-resist material. Thus, the silk-screen process is the same as described above except that the material printed onto the substrate is acid-resist material instead of electrically-resistive material.

As the next step in the method, an acid-etching step is employed to etch away all of the vapor-deposited metal excepting that which is protected by the acid resist. Thereafter, the acid-resist material is dissolved off of the metal which was thus protected, so that the only thing remaining on the surface of the substrate 10 is a pattern of vapor-deposited metal corresponding, for example, to the pattern shown and described herein. Thereafter, termination films are provided, end caps are mounted, and the environmentally-protective encapsulating layer is applied.

The word "resistive", as employed in this specification and claims, denotes a film which (a) is not an electrical insulator, (b) is an electrical conductor, (c) is not a good electrical conductor, and (d) has a substantial amount of electrical resistance.

In the present specification and claims, when reference is made to the position of the squeegee, what is actually meant is the position of the working edge 72 of the squeegee. It is a feature of the above-described compound lever system that such working edge moves in directions generally radial to the underlying substrate 10.

As emphasized above, the present apparatus and method have surprising capability relative to the smaller diameters of cylinders 10 (it being emphasized, however, that the apparatus and method are also fully operative and satisfactory relative to the larger diameters). The smaller diameters are in the range of about 0.060 to about 0.120 inch.

It is to be noted that the air jet which emanates from nozzle 59 may be referred to as an "air curtain". The major dimension of such curtain, in a direction transverse to the direction of air flow, is parallel to the line of contact between cylinder 10 and the underside of the screen.

In order that the resulting resistor will achieve effective inductance-cancellation, the width of each space 17 (FIG. 3) should be less than about 0.100 inch, and preferably less than about 0.050 inch. Much smaller spacings, such as the above-stated 0.008 inch, are greatly preferred since the cancellation of inductance is then greatly increased.

Squeegee 33 of the first embodiment (FIG. 2) corresponds to squeegee 71 of the second embodiment (FIG. 12), except that it is turned around since the direction of screening movement in FIG. 2 is opposite to that in FIG. 12. The width of the working edge 72 of squeegee 71 (and of the corresponding edge of squeegee 33) is less than the width of gap 13, and should be less than 0.015 inch.

The foregoing detailed description is to be clearly understood as given by way of illustration and example only, the spirit and scope of this invention being limited solely by the appended claims.

I claim:

1. Apparatus for effecting silk-screening of large portions of the cylindrical exterior surfaces of cylindrical substrates, including very small-diameter cylindrical substrates, which comprises:

a. a silk-screen assembly, b. means to rotatably support a cylindrical substrate beneath the screen of said screen assembly, said means including first and second roller means respectively engaged with only the end regions of the exterior cylindrical surface of said substrate, the intermediate regions of said substrate being unsupported, c. a squeegee mounted above said screen in registry with said substrate, d. means to actuate said squeegee back and forth between an upper "release" position at which said squeegee is not pressing on said screen, and a lower "pressure" position at which said squeegee presses downwardly on said screen with sufficient pressure to force said screen against said substrate, whereby movement of said screen assembly in a direction lateral to said substrate, when said squeegee is in said lower position, effects rotation of said substrate on said roller means at a speed corresponding to the speed of movement of said screen assembly, said actuating means comprising a first lever pivotally connected at one end to a support, the other end of said first lever being connected to said squeegee, e. flood-bar means comprising a second lever pivotally connected at one end to said first lever, the other end of said second lever being connected to a flood bar adapted to effect spreading of ink over said screen, f. fulcrum means pivotally related to said second lever at a region located between said flood bar and said one end of said second lever, said one end of said second lever being located between said fulcrum means and the pivotal connection between said first lever and said support, and g. means to operate said squeegee actuating means to shift said squeegee from said lower "pressure" position to said upper "release" position when said lateral screening movement of said screen assembly has been completed.

2. The invention as claimed in claim 1, in which said first lever is caused to be sufficiently heavy to effect the requisite pressing downwardly by said squeegee on said screen, and in which adjustable means are provided to determine the lowermost position of said first lever and thus the precise pressure exerted on said screen by said squeegee.

3. The invention as claimed in claim 1, in which means are provided to adjust said fulcrum means upwardly and downwardly to thereby determine the positions of said flood bar.

4. The invention as claimed in claim 1, in which said actuating means recited in clause (d) further comprises an actuator adapted to shift said first lever upwardly and downwardly.

5. The invention as claimed in claim 4, in whch said actuator is a relatively slow-acting pneumatic cylinder assembly.

6. The invention as claimed in claim 5, in which the lower end of said cylinder assembly is mounted on a support, and the upper end of said cylinder assembly bears against a roller member mounted on said first lever, said roller member preventing any binding of said cylinder assembly.

7. The invention as claimed in claim 5, in which air-throttle means are provided in the air circuit leading to said slow-acting pneumatic cylinder assembly, to thereby prevent jerking movements thereof.

8. Apparatus for effecting silk-screening of large portions of the cylindrical exterior surfaces of cylindrical substrates, including very small-diameter cylindrical substrates, which comprises:

a. a silk-screen assembly adapted to move along a predetermined path of movement, b. means to rotatably support a cylindrical substrate beneath the planar screen of said screen assembly, said means including first and second roller means respectively engaged with only the end regions of the exterior cylindrical surface of said substrate, the intermediate regions of said substrate being unsupported, said means comprising a carriage incorporating said first and second roller means and adapted to be shifted inwardly and outwardly in a direction generally parallel to the plane of said screen between a predetermined operating station underneath said screen and a load-unload station clear of said screen, c. a squeegee mounted above said screen in registry with said substrate, d. means to actuate said squeegee back and forth between an upper "release" position at which said squeegee is not pressing on said screen, and a lower "pressure" position at which said squeegee presses downwardly on said screen with sufficient pressure to force said screen against said substrate, whereby movement of said screen assembly along said predetermined path of movement and in a direction lateral to said substrate, when said squeegee is in said lower position, effects rotation of said substrate on said roller means at a speed corresponding to the speed of movement of said screen assembly, and e. means to operate said squeegee actuating means to shift said squeegee from said lower "pressure" position to said upper "release" position when said lateral screening movement of said screen assembly has been completed.

9. The invention as claimed in claim 8, in which adjustable stop means are provided on said carriage and are adapted to bear against a fixed stop portion of the silk screen apparatus, whereby to effect precise positioning of said carriage at said predetermined operating station beneath said screen, and in which means are provided to stop movement of said screen assembly at a predetermined position such that screening movement of said screen assembly has been completed and there is no over-printing of any portion of said substrate, said predetermined operating station of said carriage being closely correlated to said predetermined position of said screen assembly.

10. The invention as claimed in claim 8, in which means are provided to cause the path of movement of said carriage to be generally parallel to said path of movement of said silk-screen assembly.

11. Apparatus for silk-screening cylindrical substrates, which comprises:

a. means to rotatably support an elongated cylindrical substrate in a generally horizontal position without spindling the same or otherwise locking the same against upward movement, b. a silk screen mounted above said substrate, c. a squeegee mounted over said screen and registered with said substrate, d. means to effect biasing of said screen and said substrate against each other, said squeegee then pressing on said screen, e. means to remove said bias to thus permit said screen and said substrate to separate from each other, and f. means to direct an air jet between said substrate and said screen to thereby insure separation of said substrate from said screen.

12. Apparatus for effecting silk-screening of substrates, which comprises:

a. a silk screen, b. a squeegee and a flood bar disposed adjacent each other on one side of said screen, and c. a compound lever system to effect conjoint operation of said squeegee and said flood bar, said lever system comprising a first lever pivotally connected at one end to a support, the other end of said first lever being connected to said squeegee, said lever system further comprising a second lever pivotally connected at one end to said first lever, the other end of said second lever being connected to said flood bar, said lever system further comprising fulcrum means for said second lever and associated with said second lever at a region disposed closer to said squeegee and flood bar than is either said one end of said first lever or said one end of said second lever, said lever system further comprising means to pivot said first lever.

13. The invention as claimed in claim 12, in which said one end of said second lever is disposed between said squeegee and said one end of said first lever.

14. The invention as claimed in claim 12, in which said first lever is biased against said screen, and in which adjustable stop means is provided to stop said first lever and thus determine the squeegee pressure against said screen.

15. An apparatus for effecting silk-screening of large portions of the cylindrical exterior surfaces of cylindrical substrates, including very small-diameter cylindrical substrates, which comprises:

a. a silk-screen assembly, b. means to rotatably support a cylindrical substrate beneath the screen of said screen assembly, said means including first and second roller means respectively engaged with only the end regions of the exterior cylindrical surface of said substrate, the intermediate regions of said substrate being unsupported, c. A squeegee mounted above said screen in registry with said substrate, d. means to actuate said squeegee back and forth between an upper "release" position at which said squeegee is not pressing on said screen, and a lower "pressure" position at which said squeegee presses downwardly on said screen with sufficient pressure to force said screen against said substrate, whereby movement of said screen assembly in a direction lateral to said substrate, when said squeegee is in said lower position, effects rotation of said substrate on said roller means at a speed corresponding to the speed of movement of said screen assembly, e. means to operate said squeegee actuating means to shift said squeegee from said lower "pressure" position to said upper "release" position when said lateral screening movement of said screen assembly has been completed, and f. means to insure separation of said substrate from said screen after shifting of said squeegee from said lower "pressure" position to said upper "release" position, said means comprising an air jet directed at the region between said substrate and said screen.

16. Apparatus for effecting silk-screening of large portions of the cylindrical exterior surfaces of cylindrical substrates, including very small-diameter cylindrical substrates, which comprises:

a. a silk-screen assembly adapted to move back and forth along a predetermined path of movement, b. means to rotatably support a cylindrical substrate beneath the screen of said screen assembly, said means comprising first and second low-friction roller means respectively engaged with only the end regions of the exterior cylindrical surface of said substrate, the intermediate regions of said substrate being unsupported, said means further comprising a carriage incorporating said first and second roller means and adapted to be shifted inwardly and outwardly, generally parallel to said predetermined path of movement, between a predetermined operating station at which said cylindrical substrate is underneath said screen and a load-unload station at which said cylindrical substrate is not underneath said screen, said carriage being adapted to support a particular length and diameter of cylindrical substrate, c. a squeegee mounted above said screen in registry with said substrate when said carriage is at said predetermined operating station, d. means to effect relative movement of said squeegee and carriage, toward and away from each other, between a "release" position at which said cylindrical substrate is not engaged with said screen, and a "pressure" position at which both said squeegee and said substrate are engaged with said screen, the pressure of said engagement being sufficient that movement of said screen assembly along said predetermined path of movement effects rotation of said substrate on said roller means at a speed corresponding to the speed of movement of said screen assembly, and e. means to operate said last-named means (d) to shift from said "pressure" position to said "release" position when screening movement of said screen assembly has been substantially completed.

17. The invention as claimed in claim 16, in which adjustable stop means are provided on said carriage and are adapted to bear against a fixed stop portion of the silk-screen apparatus, whereby to effect precise positioning of said carriage at said predetermined operating station beneath said screen.

18. The invention as claimed in claim 16, in which adjustable stop means are provided on said carriage and are adapted to bear against a fixed stop portion of the silk-screen apparatus, whereby to effect precise positioning of said carriage at said predetermined operating station beneath said screen, and in which means are provided to stop movement of said screen assembly at a predetermined position such that screening movement of said screen assembly has been completed and there is no over-printing of any portion of said substrate, said predetermined operating station of said carriage being closely correlated to said predetermined position of said screen assembly.

* * * * *

UNITED STATES PATENT AND TRADEMARK OFFICE

CERTIFICATE OF CORRECTION

PATENT NO. : 4,075,968

DATED : February 28, 1978

INVENTOR(S) : RICHARD E. CADDOCK

It is certified that error appears in the above-identified patent and that said Letters Patent are hereby corrected as shown below:

Column 1, line 12, cancel "silk" and substitute --- Silk ---; same line, after "screening" insert a comma (,).

Column 3, line 59, after "is" and before "greatly" insert --- a ---.

Column 4, line 14, after "exterior" and before "of" insert --- surface ---; line 28, cancel "not" and substitute --- no ---; line 35, cancel "previous" and substitute --- pervious ---; line 37, cancel "previous" and substitute --- pervious ---; line 38, cancel "previous" and substitute --- pervious ---.

Column 5, line 38, cancel "previous" and substitute --- pervious ---.

Column 7, line 52, cancel "secured" and substitute --- screened ---.

Column 13, line 20, cancel "is" and substitute --- it ---.

Column 14, line 14, cancel "unscreen" and substitute --- unscreened ---.

Column 15, line 7, cancel "hanlde" and substitute --- handle ---; line 53, cancel "ot" and substitute --- to ---.

Column 16, line 58, after "0.060" insert --- inch ---.

Column 18, line 11, cancel "whch" and substitute --- which ---.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*